US006783295B2

(12) United States Patent
Yasunaga

(10) Patent No.: US 6,783,295 B2
(45) Date of Patent: Aug. 31, 2004

(54) APPLICATOR

(75) Inventor: Masahiro Yasunaga, Osaka (JP)

(73) Assignee: Sakura Color Products Corporation (JP)

( * ) Notice: Subject to any disclaimer, the term of this patent is extended or adjusted under 35 U.S.C. 154(b) by 0 days.

(21) Appl. No.: 10/213,215

(22) Filed: Aug. 6, 2002

(65) Prior Publication Data

US 2003/0049068 A1 Mar. 13, 2003

(30) Foreign Application Priority Data

Aug. 10, 2001 (JP) ..... 2001-244482
Jun. 28, 2002 (JP) ..... 2002-189344

(51) Int. Cl.[7] ..... B43K 5/00
(52) U.S. Cl. ..... 401/202; 401/86; 401/98
(58) Field of Search ..... 401/98, 202, 86, 401/104

(56) References Cited

U.S. PATENT DOCUMENTS 4,172,674 A * 10/1979 Paroty ..... 401/104 X
5,851,080 A * 12/1998 Nakajima et al. ..... 401/86 X

* cited by examiner

*Primary Examiner*—Gregory L. Huson
*Assistant Examiner*—Kathleen J. Prunner
(74) *Attorney, Agent, or Firm*—Wood, Phillips, Katz, Clark & Mortimer

(57) ABSTRACT

An applicator (1) is provided, such that an end closure or a proximal plug (3) fitted in a cylindrical body (2) of the applicator can be removed easily without use of a coin or the like tool. Repeated easy operations for attaching and detaching the plug will not impair firm engagement of the plug with the body, protecting the plug from inadvertently slipping off.

The plug (3) is a double-cylinder composed of an outer tube (15) combined with an inner tube (16), and two slots (30,31) are formed in the outer tube so as to extend from its rear end to, and desirably across, a flange (25). Fore ends of the slots continue to a cutout (35). An exposed part of the plug can be pinched in part to reduce its apparent diameter, thus making the outer tube sections (40,41) distort themselves elastically towards each other, thus facilitating removal of the plug.

19 Claims, 21 Drawing Sheets

APPLICATOR

BACKGROUND OF THE INVENTION

1. Field of the Invention

The present invention relates to an applicator including writing and marking instruments such as line markers, felt pens, fountain pens and ball-point pens, and more particularly relates to an applicator that comprises a cylindrical body whose open end is closed with a plug such as an end closure.

2. Description of Related Art

Most of the line markers and the like applicators have been of the disposable type to be discarded when their ink was consumed almost completely, regardless of their bodies being reusable. Therefore, some users have wanted or tried to refill such line markers or the like with a fresh amount of ink so as to use them again. Certain proposals made in view of this demand relate to applicators of an improved structure such that an end closure (also called "a proximal plug") is capable of disengagement from the cylindrical body when refilling the applicator with the ink.

The Japanese Patent Laying-Open Gazette No. 2001-105781 discloses an example of such an improved structure, wherein a deep groove is formed between an end of a cylindrical body and a penpoint holder or a proximal plug. A coin or the like hand tool can be inserted easily into this groove when the plug is to be taken off.

Thus, the above-described art applicators have necessitated coins or the like tools in removing their plugs from cylindrical bodies. Further, a lever action generated by such an operation has caused a strong stress to permanently deform the plug or an end portion of the cylindrical body adjacent to the groove. Repeated detachment of a plug will deteriorate such end portions more and more, until making it impossible to mount again the plug on the cylindrical body or making its reattached plug very prone to slip off.

SUMMARY OF THE INVENTION

An object of the present invention is therefore to provide such an applicator that its plug can readily be taken off its cylindrical body, without need of any handy tool such as a coin. The improvement has to be designed herein such that the plug is capable of repeated detachment and reattachment operations, while being protected from any serious permanent deformation and any inadvertent slipping off. In this specification, a plug can be a unitary member or can be made up of a plurality of parts.

In a first mode of the invention made to achieve this object, the applicator may comprise a cylindrical body to be filled with a liquid for application, and a plug that may be either or both of distal and proximal plugs. The plug, that may be exemplified herein as the proximal plug, is detachably attached to an open end of the applicator's cylindrical body and exposed in part to the outside. Characteristically to the present applicator, its plug may have at least one slot formed therein and extending axially of its cylindrical body such that the exposed part of the plug can be pinched centripetally to cause its elastic and temporary deformation. Owing to this feature, an inner region of the plug in a pressed contact with the cylindrical body will be forced to reduce its overall radius of curvature to thereby enable and facilitate removal of the plug.

Such a longitudinal slot or slots will render the applicator's plug ready to be distorted. If the exposed portion of the plug is pinched in a centripetal direction, then the slot or slots will permit this portion to distort itself by a distance corresponding to the width of each slot. An elastic decrease in overall diameter of the plug is thus caused in the centripetal direction, thereby producing a sufficient annular gap between the cylindrical body and the plug fitted therein, or at least weakening a contact pressure between them to such an extent as making it easy to detach the plug.

In this mode of carrying out the present invention, users of this applicator need not to use any tool or coin when they repeat to attach and detach the plug, and what is more surprising, it will never slip off inadvertently during usage or storage of this applicator. The slots may not necessarily have a uniform width between their longitudinal ends, but may each be of a varying width (as in V-shaped slots).

In a second mode of the present invention, the applicator may comprise a cylindrical body to be filled with a liquid for application, and a plug selected from the group consisting of distal and proximal plugs. The plug is detachably attached to an open end or ends of said body and exposed in part to the outside. Characteristically to this applicator, its plug may have at least one flexible portion extending axially of its cylindrical body such that the exposed part of the plug can be pinched centripetally to cause elastic and temporary deformation thereof Owing to this feature, an inner region of the plug in a pressed contact with the cylindrical body will also reduce its overall radius of curvature to facilitate removal of the plug from this body.

The term 'flexible portion or portions' as used herein, means a flexible portion that is more subject to elastic distortion than other areas adjoining to or surrounding the flexible portion by reason of at least one of a) the flexible portion having a thickness, with the thickness of the flexible portion being decreased compared to the thickness of other areas adjoining to or surrounding the flexible portion and b) the flexible portion being formed of a softer material than the material defining the other areas adjoining to or surrounding the flexible portion.

Such longitudinal flexible portions will render the applicator's plug ready to be distorted similarly to the applicator in the first mode of the invention. If the exposed portion of the plug is pinched in a centripetal direction, then the flexible portion or portions will permit the exposed portion to distort itself by a distance corresponding to the width of each flexible portion. An elastic decrease in overall diameter of the plug is thus caused in the centripetal direction, thereby producing a sufficient annular gap between the cylindrical body and the plug fitted therein, or at least weakening a contact pressure between them to such an extent as making it easy to detach the plug.

Preferably, the plug may be a proximal plug, and one of this plug and the cylindrical body has a protrusion formed integral therewith and at a portion contacting the mating body or plug. Correspondingly, the other of the cylindrical body and the proximal plug has an engageable portion that is a lug or a recess facing such a protrusion. Each longitudinal slot or flexible portion extends over and beyond the protrusion or engageable portion.

With the plug being fitted in the cylindrical body, the protrusion will be kept in engagement with the recess or lug, that is the engageable portion, so as to inhibit the plug from slipping off said body during normal use of the applicator. Since the plug has longitudinal slots formed therein and extending beyond the protrusion or engageable portion, the region where such a protrusion or portion is located will also show a significant decrease in overall diameter when the exposed region of plug is pinched centripetally. Thus, disengagement of said protrusion from said engageable portion is facilitated to enable smooth detachment of the plug from the applicator body.

Also preferably, each slot has an end opened in the exposed end face of the plug. This exposed end is a rear end of the plug if it is a proximal plug, or a fore end of the plug if it is a distal plug, and in any case, being its outer end remote from a middle region of this applicator.

By virtue of the slot or slots having their end or ends opened in the exposed end face of the plug in the described example, the plug will stand in part in a cantilevered state easy to show distortion and consequently ready removal from the cylindrical body.

Alternatively, the longitudinal slot or slots may be disposed in a middle region of the plug so that it has or they have opposite closed ends.

Even in this case, the plug's middle region is flexible enough, as compared with a middle region devoid of such slots.

Preferably, the slot or slots may be formed in a peripheral wall of the plug and this wall defines therein a central cavity.

The central cavity will permit centripetal displacement of portions of the peripheral wall when it elastically deforms itself, thus further rendering the plug easy to to be distorted and removed.

Also preferably, two or more such longitudinal slots are formed in the plug, and at least one tying slot bridges the two adjacent longitudinal slots.

In this case, peripheral wall regions of the plug, that are almost surrounded each by such longitudinal and tying slots, are in a cantilevered state to be easier to be distorted.

It may be more preferable that the two or more longitudinal slots are connected one to another by at least one tying slot continuing from one end of the two adjacent longitudinal slots.

Also in this case, the longitudinal slots having one end connected to each other by the tying slot will elongate in an axial direction the cantilevered peripheral wall regions, thus making flexible deformation (viz., distortion) thereof easier.

It also is preferable that two or more longitudinal slots are formed and at least two of them have inner ends and closed outer ends, with the 'inner ends' being connected one to another by a tying slot. This inner end is a fore end of the plug if it is a proximal plug, or a rear end of the plug if it is a distal plug. In other words, the inner end is located nearer or closer to the applicator's middle height in the drawings than an 'outer end' is.

In this case, the at least two longitudinal slots having the closed ends in addition to the inner ends connected to each other by the tying slot will provide a tongue-like cantilevered wall region. Outer end face portions of the peripheral wall close the slots' outer ends so as to serve as fulcrum-like supports for each tongue-like region, thereby rendering flexible deformation (viz., distortion) thereof much easier and smoother.

The plug in this applicator may further have one cutout or more cutouts each in communication with the one or more of the slots.

Such a cutout or cutouts noticeably shortens or shorten the boundary between the remainder of the peripheral wall and each tongue-like region surrounded thereby. These cutouts, that may preferably be slots convenient to manufacture, will also enhance capability of flexible deformation (viz., distortion) of surrounded cantilevered regions.

It also is preferred herein that the plug of the applicator is a double-cylinder composed of an inner tube coaxially enclosed with an outer tube, wherein the slots or the flexible portions are formed in the outer tube.

The plug in this case is designed such that only the outer tube is subjected to radial shrinkage. This structure will be advantageous in that the plug can be taken off the cylindrical body more lightly.

Preferably, the plug may have on its outer periphery an airtight region, which will be kept in close contact with the inner periphery of the cylindrical body.

Such an airtight region will prevent the ink or the like application liquid from leaking out through the plug, and thus protect the ink from drying up.

The outer tube of the plug may have a further region formed at least in part integral with a plurality of annular ribs. This region is located on an outside of the airtight region.

These ribs overlying one another and surrounding the outer tube are intended to protect the user's fingers from sliding over the outer periphery of plug.

In an embodiment of the present invention, the applicator comprises a cylindrical body to be filled with a liquid for application, and a plug consisting of at least one of distal and proximal plugs, the plug detachably attached to an open end or ends of said body and exposed in part to the outside. Characteristically to this embodiment, the plug is composed of an outer tube and an inner tube disposed therein and has at least one longitudinal slot formed in the outer tube and extending axially of the cylindrical body, each slot being opened in the outer exposed face of the plug. Either the plug or the cylindrical body has a protrusion formed integral therewith and at a portion contacting the mating body or plug, and correspondingly, the cylindrical body or the plug has an engageable portion that is a lug or a recess facing such a protrusion. Each longitudinal slot extends over and beyond the protrusion or engageable portion such that the exposed part of the plug can be pinched centripetally to thereby cause elastic and temporary deformation of the plug so that an inner region of the plug in a pressed contact with the cylindrical body will be forced to reduce its overall radius of curvature to thereby enable and facilitate removal of the plug from this body. The plug in this embodiment has on its outer periphery an airtight region to be brought into a close contact with the inner periphery of the cylindrical body, when fitted therein.

It is preferable in this embodiment that the number of the slots is at least two and each slot has an inner end continuing to an extension lying along the peripheral circumference of the outer tube.

In this type of the applicator, each portion almost surrounded by the slots and extension is adjoined by a shortened boundary to the neighboring portion and is therefore easier to distort.

Also preferably, each slot has an inner end continuing to extensions formed along the peripheral circumference of the outer tube, thereby assuming a T-shape as a whole.

In another embodiment, the applicator comprises a cylindrical body to be filled with a liquid for application, and a plug consisting of at least one of distal and proximal plugs, the plug detachably attached to an open end or ends of said body and exposed in part to the outside. Characteristically to this embodiment, the plug is composed of an outer tube and an inner tube disposed therein and has at least two longitudinal slots formed in the outer tube and extending axially of the cylindrical body, wherein the at least two of the slots have outer ends closed and inner ends connected one to another by a tying slot. Either such a plug or the cylindrical body has a protrusion formed integral therewith and at a portion contacting the mating body or plug, and correspondingly, the cylindrical body or the plug has an engageable portion that is a lug or a recess facing such a protrusion. Each longitudinal slot extends over and beyond the protrusion or engageable portion such that the exposed part of the plug can be pinched centripetally to thereby cause elastic and temporary deformation of the plug so that an inner region of the plug in a pressed contact with the cylindrical body will be forced to reduce its overall radius of curvature to thereby enable and facilitate removal of the plug from this body. The plug in this embodiment also has on its outer periphery an airtight region to be brought into a close contact with the inner periphery of the cylindrical body, when fitted therein.

It is desirable that the number of such longitudinal slots is an even number so that one or more pairs of them are provided, and the two slots forming one pair have the inner ends communicating one with another through the tying slot. These three slots constitute as a whole a generally U-shaped composite slot, which defines therein a tongue-shaped region.

A basal outer end of such a tongue-shaped region will serve as a fulcrum-like support rendering this region more easy to elastically deform (viz., distort) itself.

More preferably, the number of such longitudinal slots is four so that there are provided a first slot, a second slot, a third slot and a fourth slot. The first and second slots form a first pair, with the third and fourth slots forming a second pair. The two slots forming each pair have their inner ends communicating one with another through the tying slot. These three slots constitute as a whole a generally U-shaped composite slot, which defines therein a tongue-shaped region.

The user will be able to lightly and readily disengage the plug from the cylindrical body of applicator, because he or she need to just pinch the plug at its two tongue-shaped regions that preferably face one another in a diametric direction. Although two pairs of such tongue-shaped regions facing one another may be provided (by forming eight slots), one pair of them suffice well for the plug to be manufactured as simply as possible.

DESCRIPTION OF THE PREFERRED EMBODIMENTS

Now some embodiments of the invention will be described, wherein the wordings 'fore' and 'rear' are meant to denote ends or portions of an applicator as to its posture in use. The end and region or portion including, facing or located adjacent to a penpoint are referred to as a fore end and a fore region or portion, respectively. The other end and region or portion on the side of the plug are likewise referred to as a rear end and a rear region or portion. The outer end of the end closure is thus a rear end thereof, and the inner end of the end closure is a fore end thereof.

Figure 1:
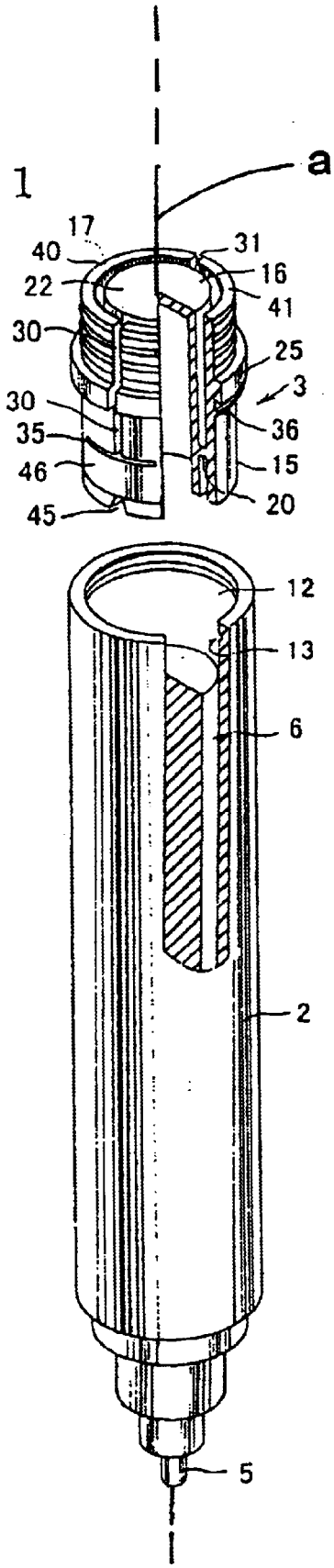
FIG. 1 is an exploded perspective view of an applicator provided in a first embodiment of the present invention and shown partly in cross section, with an end closure (a proximal plug) having been separated from or not yet been fitted in a cylindrical body of the applicator.
Figure 2B:
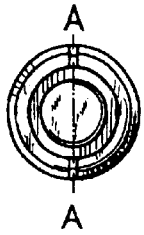
FIG. 2B is a plan view of the applicator shown in FIG. 1.
Figure 2A:
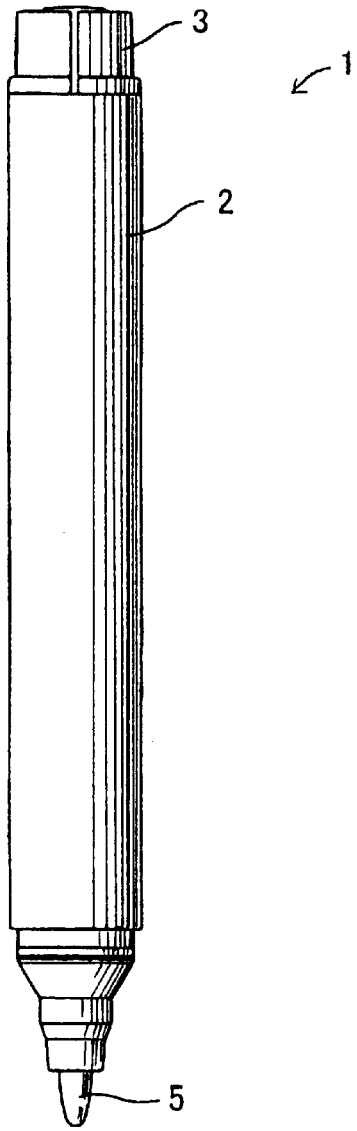
FIG. 2A is a front elevation of the applicator shown in FIG. 1.
Figure 3B:
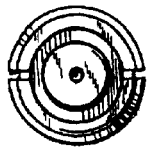
FIG. 3B is a plan view of the applicator shown in FIG. 1.
Figure 3A:
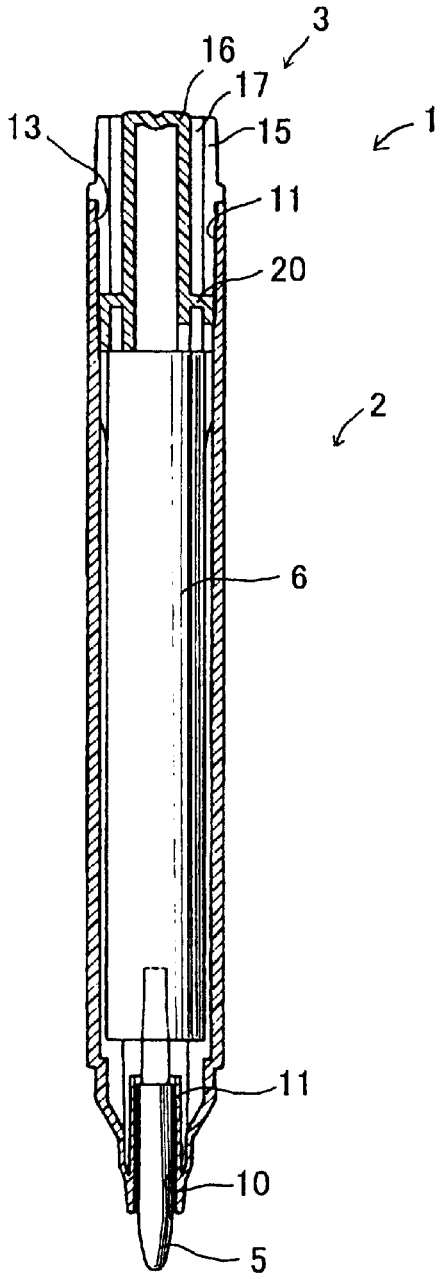
FIG. 3A is a vertical cross section of the applicator shown in FIG. 1.

Each applicator herein is shown with a cylindrical shape with a central, longitudinal axis, as shown on the exemplary applicator in FIG. 1 at a. The description of the separate components for the applicator herein are likewise described in relationship to the same axis a. The 'fore' and 'rear' designations are spaced along the axis a.

Figure 6:
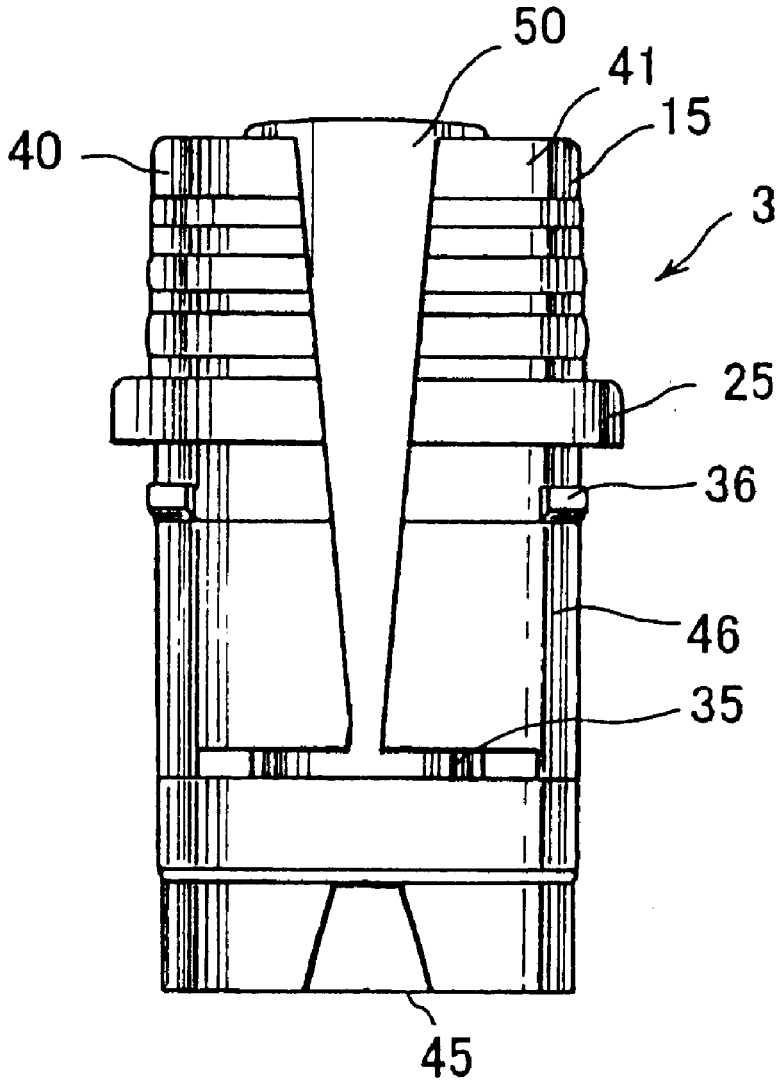
FIG. 6 is a front elevation of the end closure employed in a second embodiment.
Figure 7:
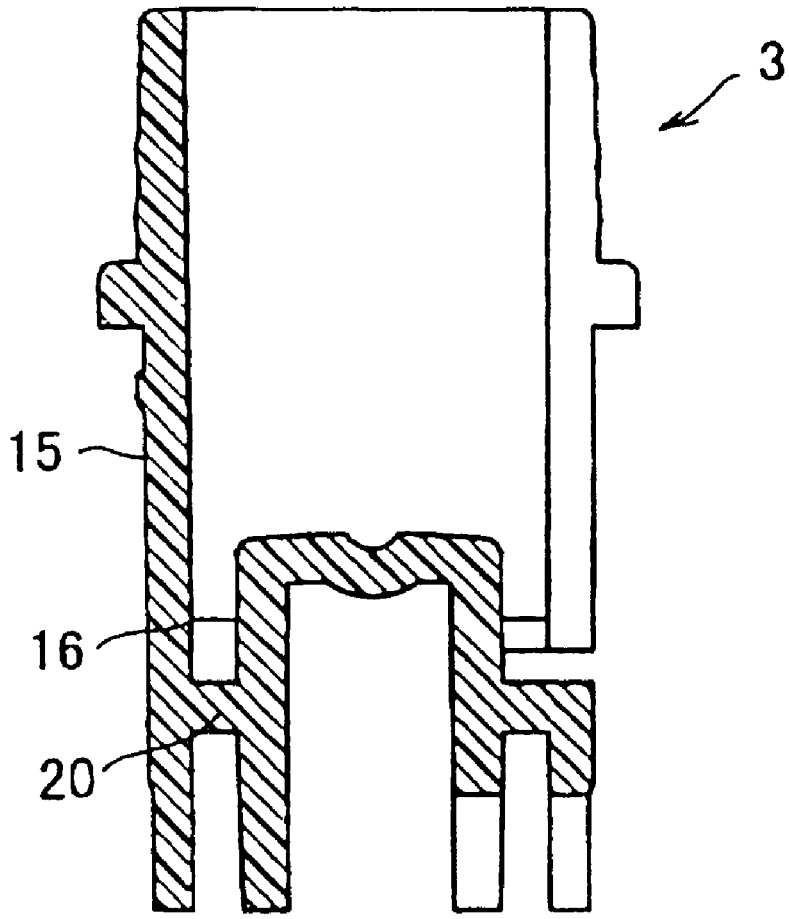
FIG. 7 is a cross section of the end closure employed in a third embodiment, taken similarly to FIG. 4E.

FIGS. 1 to 7 show an applicator 1 provided herein, in which its end closure 3 has slots 30, 31 or 50 whose open ends are located at the proximal end of said end closure. FIGS. 1 to 5 illustrate a first embodiment, and FIG. 6 is a scheme of a second embodiment, with FIG. 7 being a scheme of a third embodiment.

The applicator 1 in these embodiments is a felt pen composed of a cylindrical body 2, the end closure 3, a penpoint tip 5 and an ink-occlusion column 6. The cylindrical body 2 is an article molded of a polypropylene resin or the like to have opposite open ends. As seen best in FIG. 3A, the fore end portion of this body 2 gradually reduces its diameter, so as to provide a fore end opening 10. The penpoint tip 5 that is fixed in a penpoint holder 11 retained in this end opening is formed of a material such as a cluster of bonded acrylic fiber bundles or the like. The ink as a liquid for application will migrate and transfer into this penpoint tip 5, due to its capillary action.

A rear end opening 12 of the cylindrical body 2 has the end closure 3 fitted therein. An annular groove 13 formed in the inner periphery of said body 2 is located close to the rear end face thereof. As will be detailed below, a rib-shaped protrusion 36 of the end closure will engage with this annular groove 13, which may be replaced with an annular rib-shaped lug or with a proper uncontinuous ridge or the like.

The end closure 3 is a characteristic part in this embodiment, and will be described in detail. It is a double-cylinder composed of an outer tube 15 as the outer periphery of this closure 3 and an inner tube 16 formed to be coaxial with the outer tube. The inner diameter of said outer tube 15 is significantly larger than the outer diameter of the inner tube 16, such that an annular cavity is defined between them. A transverse and annular tying wall 20 (serving as an airtight region) is formed integral with fore portions of those tubes 15 and 16, to be located near their fore ends. Thus, the outer and inner tubes are tightly adjoined one to another by such a thin annular transverse wall 20 that is merely about 1 mm thick in the longitudinal directions of this end closure.

The inner tube 16 of the same length as the outer tube has its fore end opened and its rear end 22, which is axially spaced from the fore end, closed.

On the other hand, both the fore and rear ends of the outer tube 15 are open. such open ends of this tube are however not in fluid communication with each other, because the annular transverse wall 20 intervenes between them.

A flange 25 formed on and integral with the outer periphery of outer tube 15 is spaced about a third of its length from its rear end and is thus located rearwardly (upwardly in the drawings) of the annular tying wall 20.

Annular ribs formed also on the outer periphery and rearwardly of the flange 25 overlie one another in a stepped fashion. The inner (fore) region of said outer periphery of outer tube is located ahead the flange 25 and generally has a smooth surface, whose diameter is equal to the inner diameter of cylindrical body 2.

Two slots 30 and 31 are formed in the outer tube 15 to extend from its rear end and forwards across the flange 25. The two longitudinal slots 30 and 31 are opposed diametrically to each other and each extend through the axially facing outer end face of the exposed part of the end closure/plug 3 to the outside. Those slots are located symmetrical about the axis of outer tube 15, so that they are spaced one from another an angle of 180 degrees.

Figure 4C:
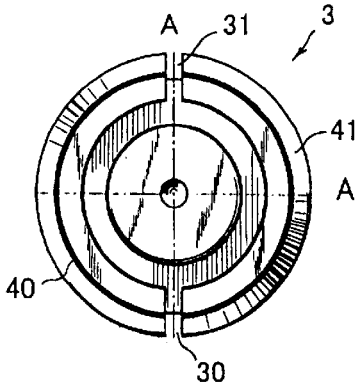
FIG. 4C is a top plan view of the end closure.
Figure 4B:
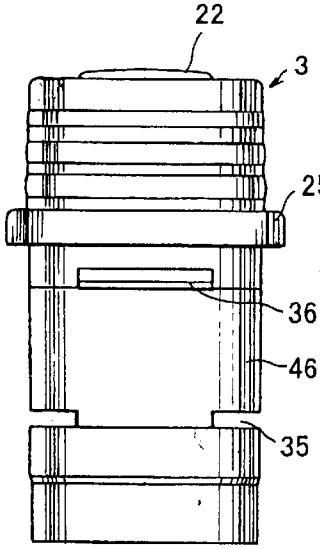
FIG. 4B is a left-side elevation of the end closure.
Figure 4A:
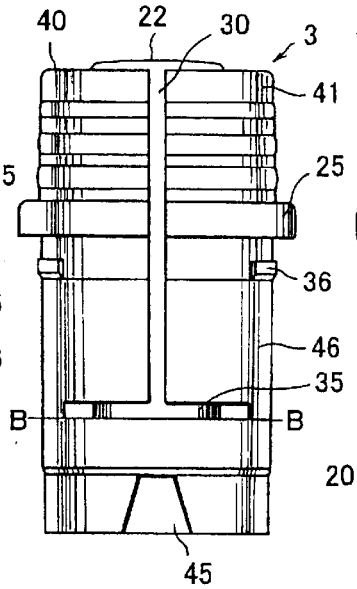
FIG. 4A is a front elevation of the end closure employed in the first embodiment shown in FIG. 1.
Figure 4E:
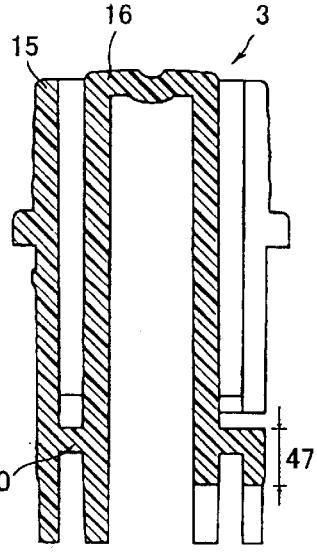
FIG. 4E is a cross section taken along the line A—A in FIG. 4C.
Figure 4D:
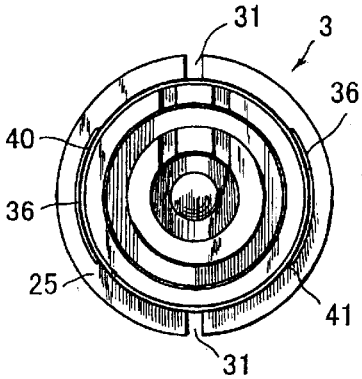
FIG. 4D is a bottom plan view of the end closure.
Figure 4F:
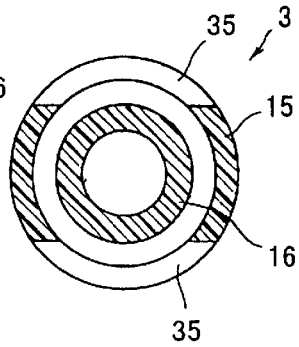
FIG. 4F is a cross section taken along the line B—B in FIG. 4A.
Figure 5:
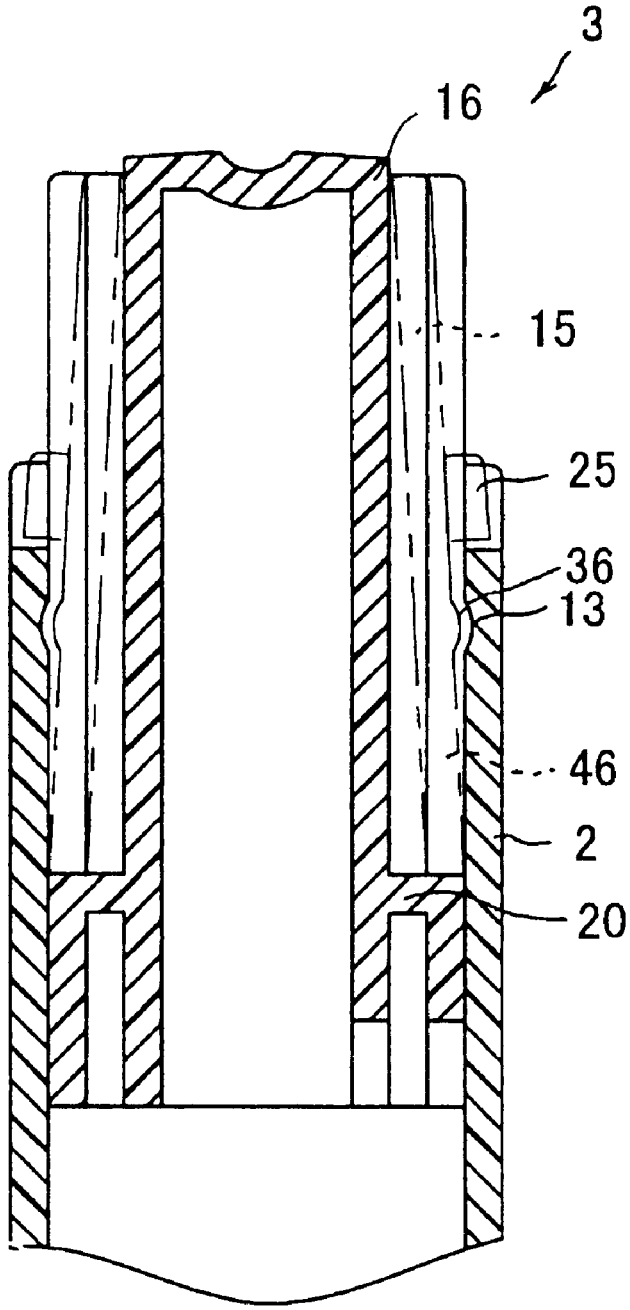
FIG. 5 is an enlarged cross section of a region around the end closure shown in use.

As will be seen in FIGS. 1 and 4A, the fore axial end (viz., inner end) of each of longitudinal slots 30 and 31 continues to a transverse cutout 35 of the same width as them. In detail, the fore end of each longitudinal slot joins the transverse cutout 35 at the middle point of the cutout 35. This cutout formed also as a slot extends sideways in opposite directions from its middle point, such that it assumes a reversed T-shape together with the longitudinal slot.

Two latching protrusions 36 each rib-shaped are formed on the outer periphery of outer tube 15, at a position thereof slightly forwardly (downwardly in the drawings) of the flange 25. Each latching protrusion 36 is an arc in plan view and extends an angle of about 90 degrees in the present embodiment. Also in this plan view, a line including both the centers of those protrusions 36 intersects a plane including both the longitudinal slots 30 and 31. Therefore, in plan view of the outer tube 15, those latching protrusions 36 are located at respective middle regions of two complementary sections 40 and 41 of said outer tube divided by the longitudinal slots.

If the end closure 3 is viewed in a fore-and-aft direction, then it will be observed that those slots 30 and 31 extend from its rear end and beyond the latching ribs 36.

Cutouts 45 are formed in the fore end (lower end in the drawings) of the outer tube 15, so as to avoid a negative pressure occurring in the ink-occlusion column 6.

As noted above, the end closure 3 fits in the rear end opening 12 of cylindrical body 2, as shown in FIGS. 2A, 2B, 3A and 3B. In more detail, the closure's forward fixed portion 46 located ahead the flange 25 is inserted in the rear end opening 12 of the cylindrical body 2 so that the inner periphery thereof is kept in a pressed contact with the outer periphery of the outer tube of said portion. Thus, such a forward portion 46 serves in this embodiment as a fixed basal region in the closure, with this portion's latching ribs 36 firmly engaging the cylindrical body's annular groove 13 to prevent the slipping off of said closure.

A part of the closure's forward portion 46 will function also as an airtight region 47 in this embodiment. This is because the forward portion 46 has a substantially smooth periphery and its peripheral zone or region 47 interposed between the fore ends of slots 30 and 31 and the cutouts 45 has no indent or the like irregularity. The airtight region 47 thus kept in a close contact with the inner periphery of cylindrical body 2 over its full circumference will inhibit the ink to leak through this end closure 3.

As the applicator 1 is used many times, its ink will be consumed gradually. If and when the user feels the applicator scratchy to make his or her writing blurred, then he or she can detach the end closure 3 so as to refill the applicator with the ink.

In the applicator 1 of this embodiment, its end closure 3 will be pinched at its exposed portion with his or her fingers to easily dismount it. The annular cavity 17 intervenes between the outer and inner tubes 15 and 16, so that such a pinching of the exposed portion will cause the outer tube 15 to distort itself towards the cavity 17. It is to be noted in this connection that the longitudinal slots 30 and 31 formed in the outer tube 15 divide it into the sections 40 and 41, both being supported in a cantilevered fashion. Therefore, these sections are ready to make elastic deformation inwardly towards each other. In particular, the cutouts 35 extending transversely from the fore end of each longitudinal slot 30 and 31 are effective to lower secondary bending moment in cross section of the basal region of each section 40 and 41. By virtue of this feature of the present embodiment, the sections will bend themselves at their basal ends to decrease the apparent overall diameter of the outer tube 15.

Also particularly in this embodiment, the slots 30 and 31 extend forwards beyond the rib-shaped protrusions 36, 50 that the complementary sections 40 and 41 will bend themselves at their portions adjacent to the fore ends of slots. Distortion of these sections will cause inward and centripetal displacement of the rib-shaped protrusions 36, thereby disengaging them from the annular groove 13 as indicated at the phantom lines in FIG. 5 and simultaneously weakening the pressure between the closure's forward fixed portion 46 and the cylindrical body 2. Thus, the user can pull lightly the end closure 3 in its axial direction out of the cylinder to easily refill it with the ink.

Although two longitudinal slots 30 and 31 are formed in the embodiment described above, the number of them may be changed if so desired. Those slots each having a constant width over their full length in this embodiment may be replaced with any other slot or slots whose width changes in axial direction of the end closure. FIG. 6 shows such an alternative example, viz., the second embodiment wherein a V-shaped slot 50 gradually decreases its width from its rear end. The V-shaped slot 50, like the slots 30, 31, extends through the axially facing outer end of the exposed part of the end closure/plug 3. Other structural elements are the same as or similar to those in the first embodiment, and therefore description thereof will not be repeated. They will be indicated here simply with the same reference numerals as those in the preceding embodiment.

The V-shaped slot 50 is advantageous in that the cantilevered sections 40 and 41 of the outer tube can be distorted in more distance at their rear end portions (upper portions in the drawings) than at their fore end portions. This means that the outer tube with such a V-shaped slot 50 in the end closure is much easier to reduce its temporary diameter.

The slots 30 and 31 can be dispensed with, if the regions corresponding thereto in the outer tube are considerably thinned, or are formed with a softer material of a lesser modulus of elasticity, as compared with the remainder regions. Also in such a case, the outer tube will be ready to distortion to easily detach the end closure.

In the preceding preferred embodiments, each longitudinal slot 30 and 31 continues to the transverse cutout 35 to facilitate elastic deformation of the outer tube sections 40 and 41. The described advantages of the present invention will however be ensured well without aid of such cutouts, but requiring just a little stronger finger forceto deform the outer tube.

The cutouts may preferably be deformed at the fore end of each longitudinal slot 30 and 31. However they can be located intermediate between the fore and rear ends of slot, but desirably ahead the latching rib-shaped protrusions 36.

The end closure in the preceding embodiments is a double-cylinder composed of outer and inner tubes 15 and 16 of the same length. In a modification as the third embodiment of the invention shown in FIG. 7, these hollow tubes are of different lengths. It also is possible to make the inner tube not hollow but solid.

The annular and transverse tying wall 20 connecting the outer tube 15 to the inner tube 16 is located near their fore ends in the foregoing embodiments. The wall 20 may however connect the rear ends of said tubes to each other.

The embodiments described above employ the latching rib-shaped protrusions 36 formed on the end closure (proximal plug) 3 to fit in the recess formed in the cylindrical body 2. This is for the purpose of more surely retaining the end closure in said body, but the invention will work well even if the closure or body were devoid of any such protrusions 36.

All the slots 30, 31 and 50 have open rear ends, though they may have no open ends in a case wherein the end closure has elongate and narrow holes as the slots located intermediate between its opposite ends.

Next, a fourth embodiment will be described referring to FIGS. 8 to 11F showing an end closure that has slots at its intermediate portions. Other structural elements are the same as or similar to those in the first to third embodiments. Therefore, they will not be so detailed but be simply indicated here at the same reference numerals as in the foregoing embodiments.

An applicator 60 in the fourth embodiment is also a felt pen comprising the cylindrical body 2, an end closure 61, the penpoint tip 5 and the ink-occlusion column 6. Three of these parts 2, 5 and 6 are of the same structure as those in the preceding embodiments.

The end closure 61 is almost of the same structure as that in the first embodiments, except for its slots. This closure 61 is also a double cylinder composed of the outer and inner tubes 15 and 16 that are formed coaxial with each other and have between them an annular cavity 17. The annular tying wall 20 having a thickness of about 1 mm connects the fore end portion of outer tube 15 to that of inner tube 16.

The inner tube 16 of the same length as the outer tube 15 is open at its fore end and closed at its rear end 22, as is the case with the first embodiment. Both the fore and rear ends of the outer tube 15 are open ends, but are not in fluid communication with each other due to the presence of annular tying wall 20.

The outer configuration of the outer tube 15 resembles that in the preceding embodiments, since it has the flange 25 located at a third of length from its rear end and rearwardly (upwardly in the drawings) of the tying wall 20.

Also in this case, annular ribs are formed on the outer tube and behind (above in the drawings) the flange 25, one above another. Fore region located ahead the flange is substantially smooth and has an outer diameter equal to inner diameter of the cylindrical body 2.

Thus, the end closure 61 shown in FIGS. 8 to 11F is almost the same as that shown in FIGS. 1 to 5, but significantly differs from it with respect to the shape of slots. The outer tube 15 of this closure 61 has four slots 62, 63, 64 and 65 formed intermediate between the fore and rear end faces of the closure 61 so as not to have any end exposed to the outside. Each slot 62 to 65 has a rear end located ahead the rear face of said closure, and extends forwards ahead the flange 25.

Figure 8:
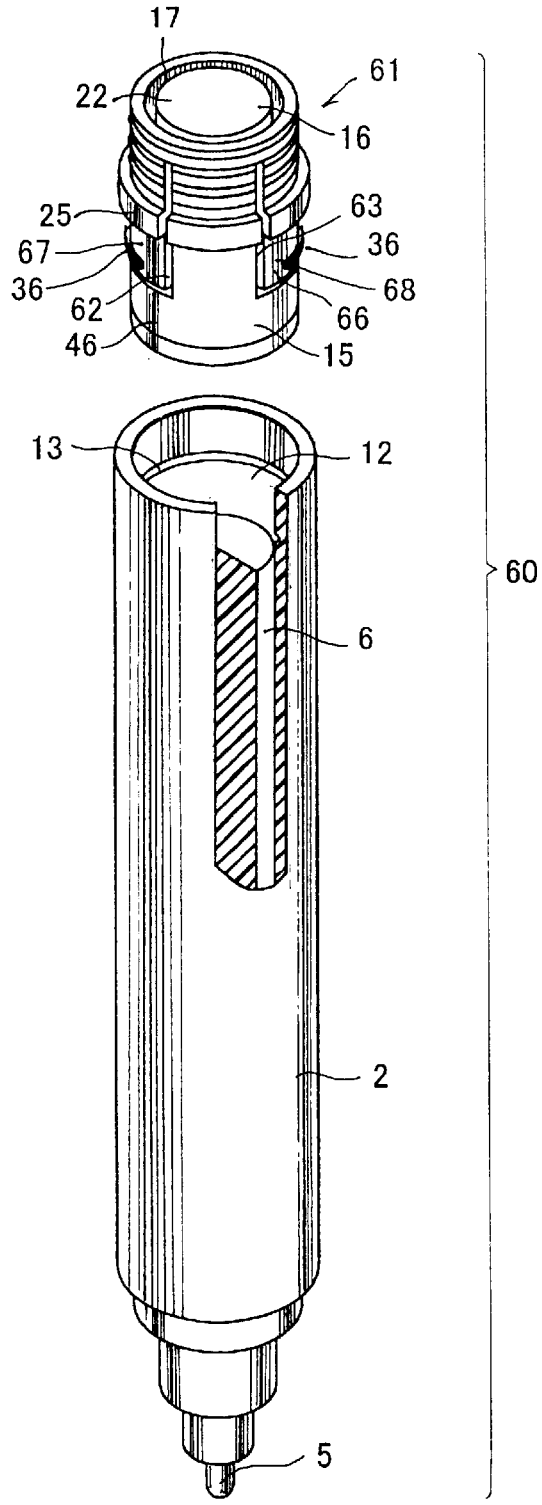
FIG. 8 is an exploded perspective view of the applicator in a fourth embodiment, with an end closure detached from a cylindrical body of the applicator.
Figure 9:
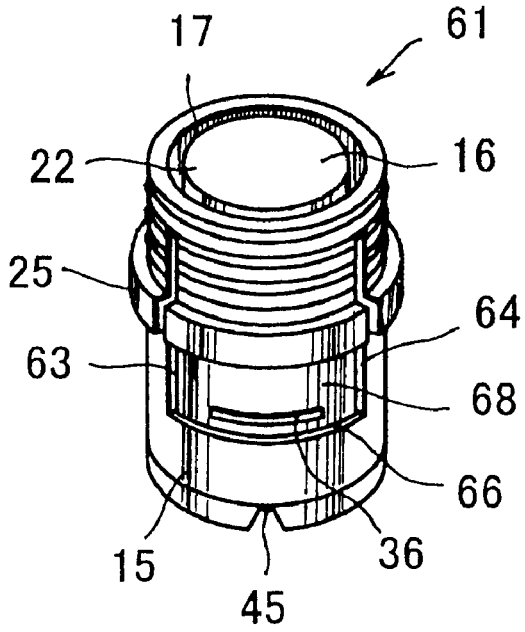
FIG. 9 is a perspective view of the end closure shown in FIG. 8 and seen at a different angle of view.
Figure 10:
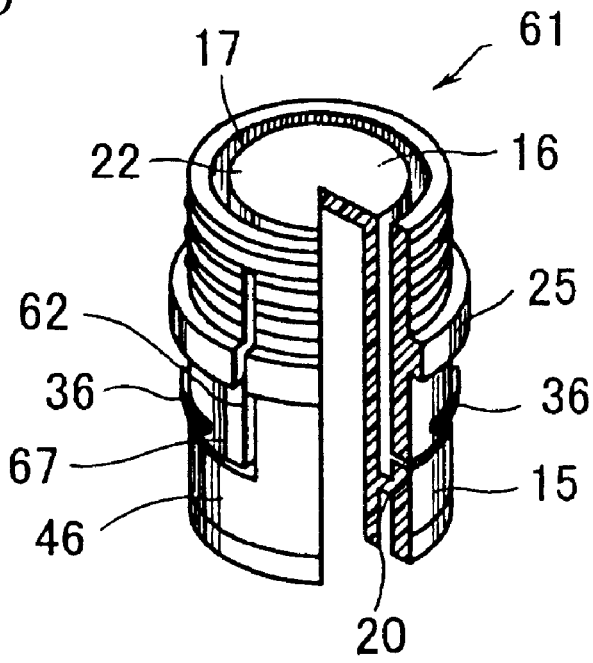
FIG. 10 is a perspective view of the end closure shown in FIG. 8 and partly in cross section.
Figure 11C:
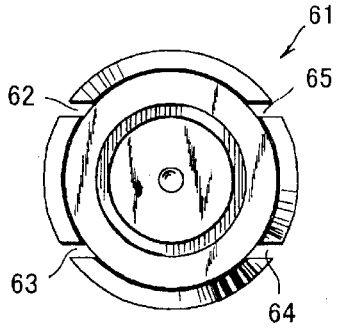
FIG. 11C is a top plan view of the end closure shown in FIG. 11A.
Figure 11B:
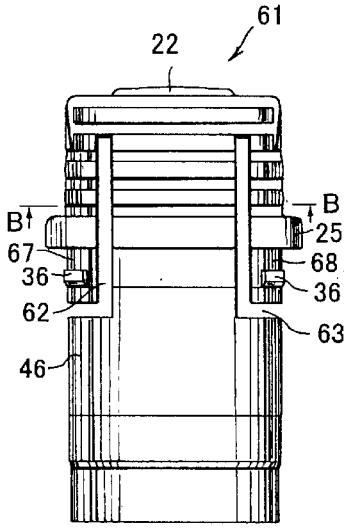
FIG. 11B is a left-side elevation of the end closure shown in FIG. 11A.
Figure 11A:
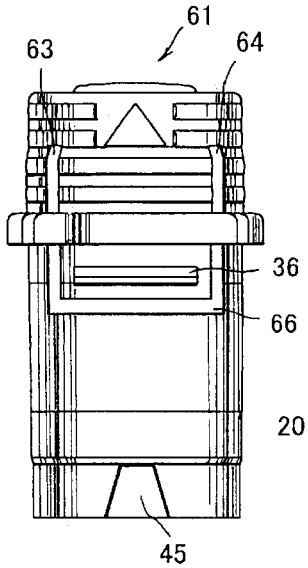
FIG. 11A is a front elevation of the end closure employed in the fourth embodiment.
Figure 11E:
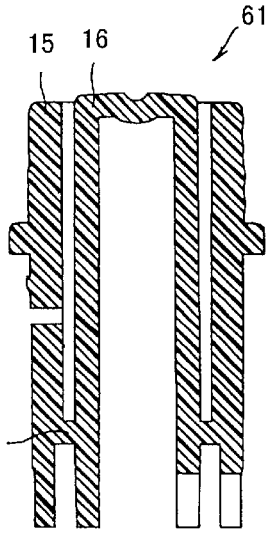
FIG. 11E is a cross section taken along the line A—A in FIG. 11D.
Figure 11D:
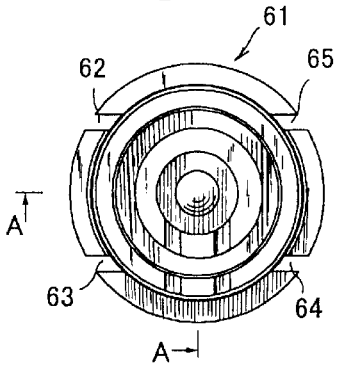
FIG. 11D is a bottom plan view of the end closure shown in FIG. 11A.
Figure 11F:
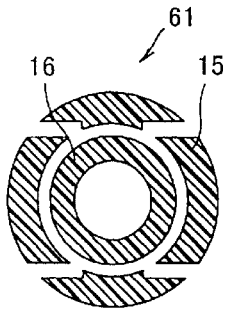
FIG. 11F is a cross section taken along the line B—B in FIG. 11B.
Figure 12:
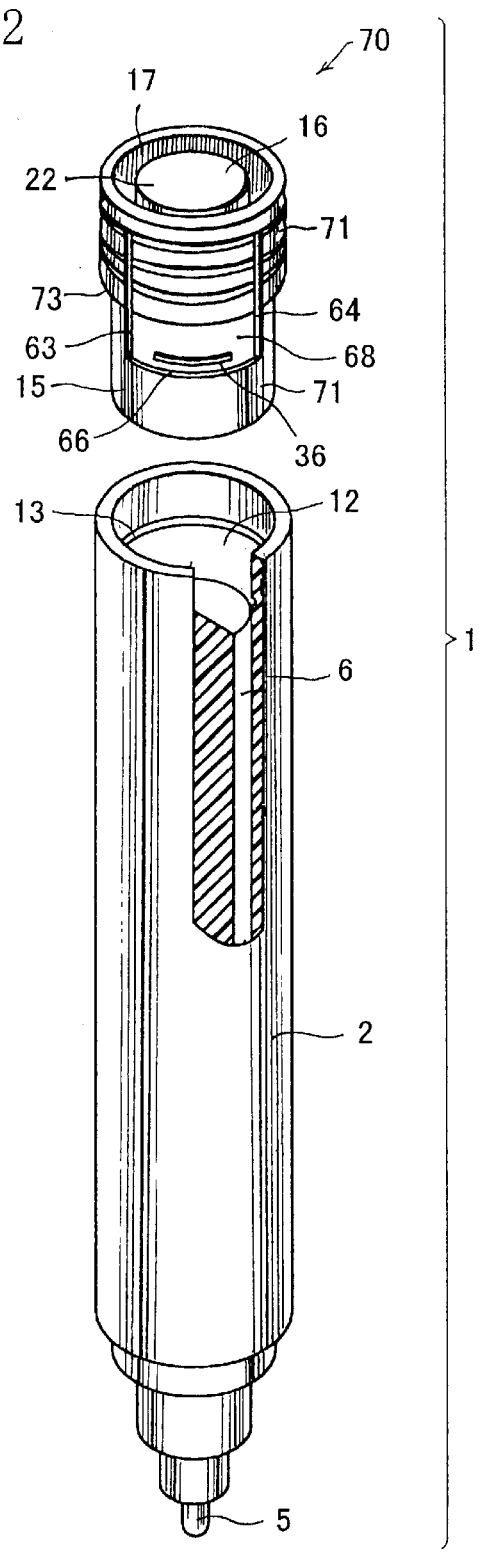
FIG. 12 is an exploded perspective view of the applicator in a fifth embodiment, with an end closure detached from a cylindrical body of the applicator.
Figure 13:
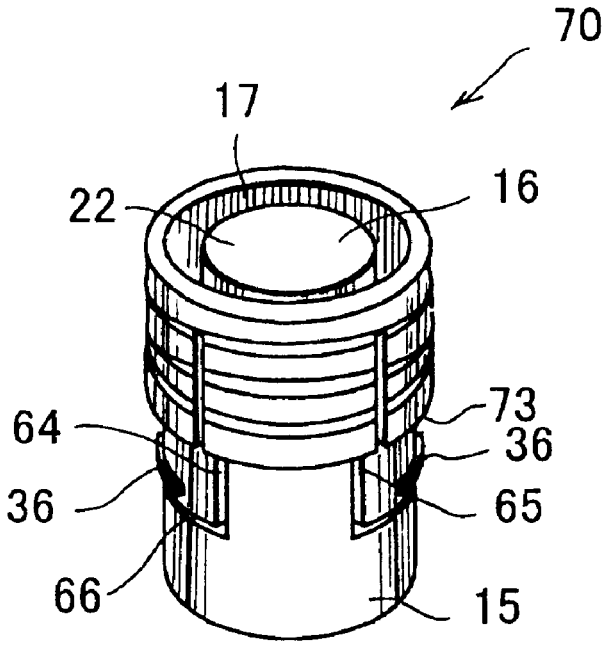
FIG. 13 is a perspective view of the end closure shown in FIG. 12 and seen at a different angle of view.
Figure 14:
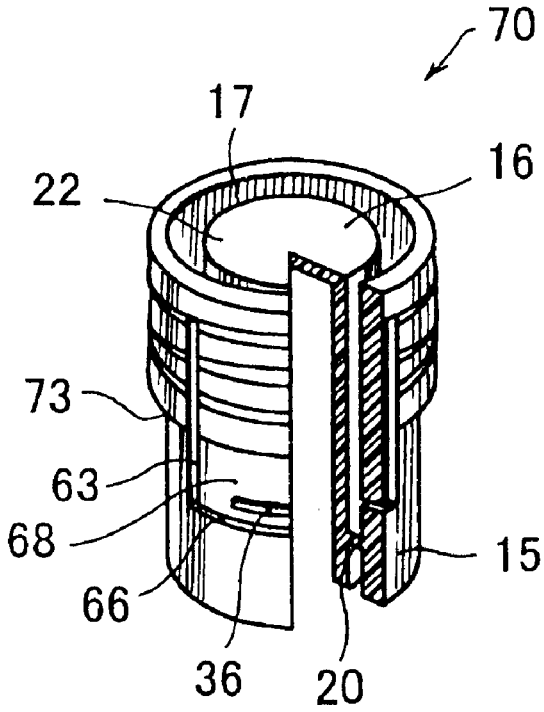
FIG. 14 is a perspective view of the end closure shown in FIG. 12 and partly in cross section.

Two neighboring ones 63 and 64 of these slots are coupled to have their fore ends tied with a connection slot 66, generally assuming as a whole a U-shape on the outer tube 15. A generally U-shaped tongue-like region 67 thus formed in the outer tube 15 has three sides defined by the slots, with a basal end of this region integral with the body of this end closure. Another pair of slots 65 and 62 have also their fore ends tied with a further connection slot (as seen in FIG. 8) so as to define a similar tongue-like region 68.

The connection slots 66 extend along circumference of the outer tube, and thus perpendicularly to the longitudinal slots 62 to 66.

Two rib-shaped latching protrusions 36, that are arc-shaped portions of the outer tube periphery, are located each ahead (below in the drawings) the flange 25. One of the protrusions 36 is disposed in the tongue-shaped region 67 between the longitudinal slots 63 and 64 and close to the tying slot 66. The other protrusion 36 is located in the other tongue-shaped region 68 between the further longitudinal slots 65 and 62 and likewise close to the other tying slot (as seen in FIG. 8). Similarly to the foregoing embodiments, cutouts or notches 45 are formed additionally in the fore end of the outer tube 15.

Also in the present embodiment, the end closure 61 fits in the rear end opening 12 of cylindrical body 2. The latching ribs 36 formed in the closure's fixed basal region 46 firmly engages with the cylindrical body's annular groove 13 to prevent the slipping off of said closure 61.

When removing the end closure 61 from the applicator 60 of this embodiment, its exposed portion will be pinched for example with the user's fingers, similarly to the foregoing embodiments. Particularly in the present embodiment, the tongue-shaped regions 67 and 68 will be pressed inwards in radial direction. Since these regions are cantilevered and the annular cavity 17 is present between the outer and inner tubes 15 and 16, each tongue-shaped region 67 and 68 will be lightly caused to make an inward elastic deformation as the outer tube 15 is deformed toward the cavity 17 when the exposed portion is pinched, i.e., the regions 67 and 68 are pressed inwards. It is a feature peculiar to and inherent in this embodiment that latching protrusions 36 are formed in the respective cantilevered tongue-shaped regions 67 and 68 and close to their free ends. Inward displacement of those protrusions 36 will thus take place an increased distance as compared with the foregoing embodiments, when the outer tube 15 is forced towards and into the annular cavity 17. The latching protrusions 36 formed on the closure's forward fixed portion 46 will readily disengage from the annular groove 13, so that the user can pull the end closure 61 off the cylindrical body very easily for the purpose of refilling it with the ink.

The end closure in each embodiment described above has the flange 25 to apparently define three areas arranged in series on the outer periphery of lug, although such a flange can be dispensed with in the present invention.

FIGS. 12 to 15F illustrate the fifth embodiment wherein an end closure 70 has no such a flange.

This end closure 70 lacks the flange, but is almost similar to the closure of the fourth embodiment shown in FIGS. 11A to 11F. The end closure 70 in the fifth embodiment is composed of a larger-diameter region 71 and a smaller-diameter region 72. A stepped portion or shoulder 73 interposed between these regions 71 and 72 serves as a flange, because it will bear against the face of open end of the cylindrical body 2 when the closure is inserted therein. The smaller-diameter region 72 located ahead the shoulder 73 fits in the rear opening 12 of the cylindrical body 2, such that the outer periphery of this region 72 will function as the forward fixed portion 46 kept in a tight contact with the inner periphery of said body.

Figure 15C:
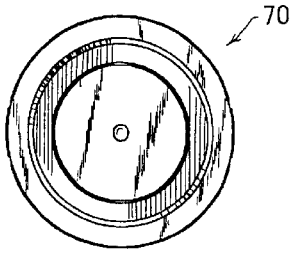
FIG. 15C is a top plan view of the end closure of FIG. 15A.
Figure 15B:
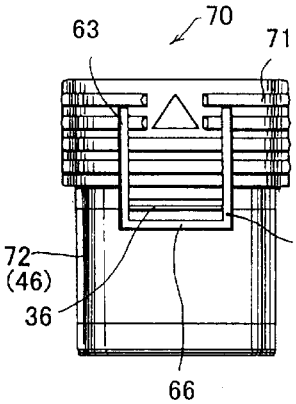
FIG. 15B is a left-side elevation of the end closure of FIG. 15A.
Figure 15A:
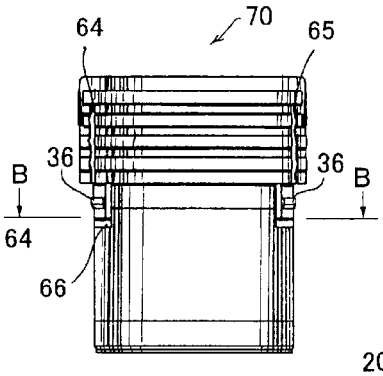
FIG. 15A is a front elevation of the end closure in the fifth embodiment.
Figure 15E:
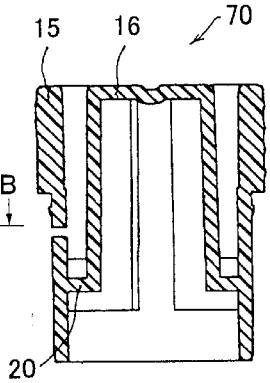
FIG. 15E is a cross section taken along the line A—A in FIG. 15D.
Figure 15D:
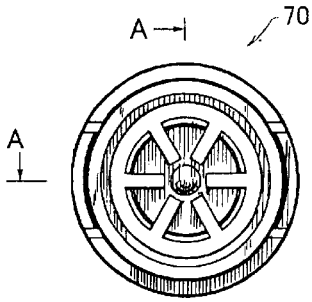
FIG. 15D is a bottom plan view of the end closure of FIG. 15A.
Figure 15F:
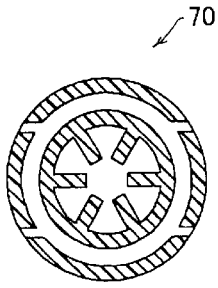
FIG. 15F is a cross section taken along the line B—B in FIG. 15A.

Also in this end closure 70 of the fifth embodiment, its outer tube 15 has four slots 62, 63, 64 and 65. Similarly to the fourth embodiment, these slots are formed intermediate between the fore and rear end faces of the outer tube 15 so as not to have any end exposed to the outside. Two neighboring ones 63 and 64 of these slots are coupled to have their fore ends tied with a connection slot 66. One of the rib-shaped protrusions 36 is disposed in a generally U-shaped tongue-like region 67 having three sides defined by the slots 63, 64 and 66. This protrusion 36 is positioned near the connection slot 66. Another pair of slots 65 and 62 have also their fore ends tied with a further connection slot (as seen in FIG. 15A) so as to define a similar tongue-like region 68. The other protrusion 36 is also positioned near the further connection slot 66.

The tongue-shaped regions 67 and 68 will be pressed inwardly and radially, when removing the end closure 70. Elastic and smooth deformation of these regions will displace the rib-shaped protrusions 36 to disengage from the annular groove 13.

Although all the embodiments described above are directed to the end closure (proximal plug), the present invention can of course apply to a distal plug holding a penpoint tip.

Exemplary distal plugs 75, 76, and 77 are shown in FIGS. 16 through 17D, 18 through 20, and 21, respectively. The distal plug 75 is substantially similar to the end closure (proximal plug) 3 in the first embodiment shown in FIG. 1, except that the plug 75 has a penpoint tip holder 80 on its outer end remote from the cylindrical body 2. Similarly, the distal plug 76 is substantially similar to the end closure 60 in the fourth embodiment shown in FIG. 8, except that the plug 76 has a penpoint tip holder 80 on its outer end remote from the cylindrical body 2. As to the distal plugs 75 and 76, other structural elements thereof that are the same as or similar to those of the end closures 3, 60 in the preceding embodiments will be indicated here simply with the same reference numerals as those in the preceding embodiment and description thereof will not be repeated.

Figure 16:
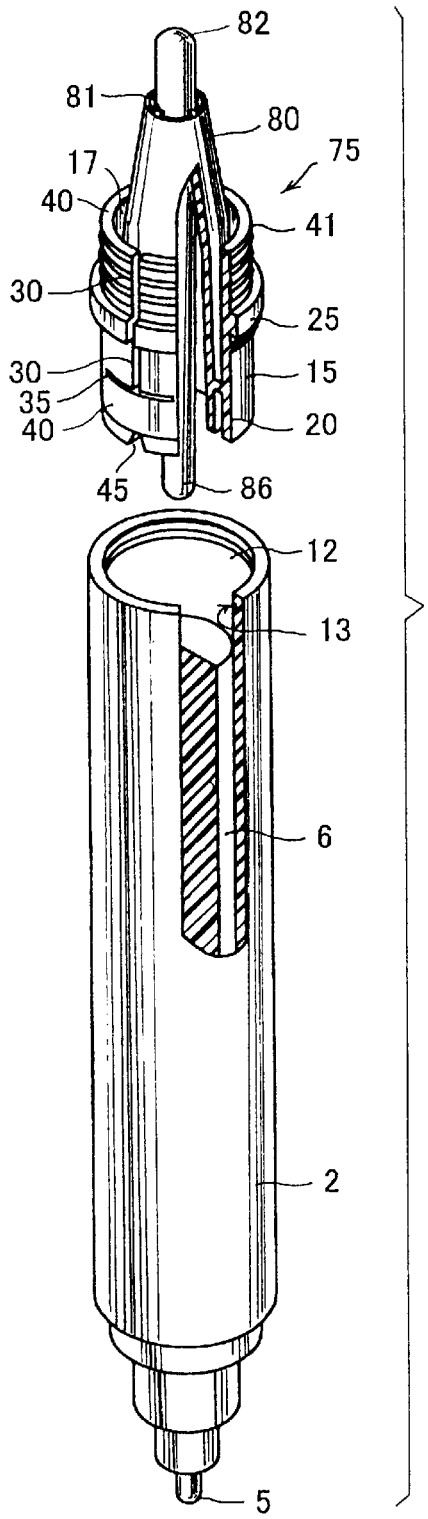
FIG. 16 is a perspective view of an applicator provided in a sixth embodiment of the present invention and shown partly in cross section, with a distal plug having been separated from or not yet been fitted in a cylindrical body of the applicator.
Figure 17C:
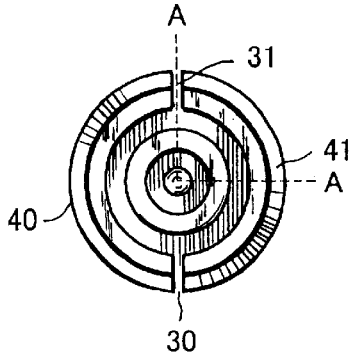
FIG. 17C is a top plan view of the distal plug.
Figure 17B:
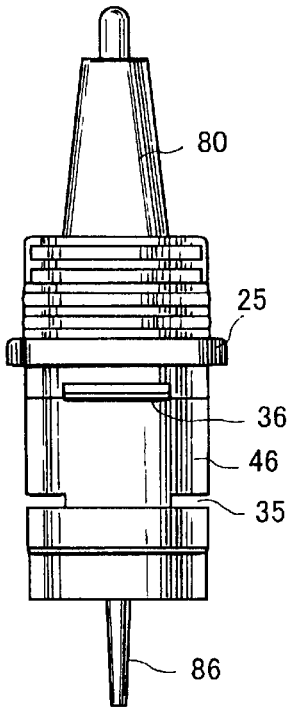
FIG. 17B is a left-side elevation of the distal plug.
Figure 17A:
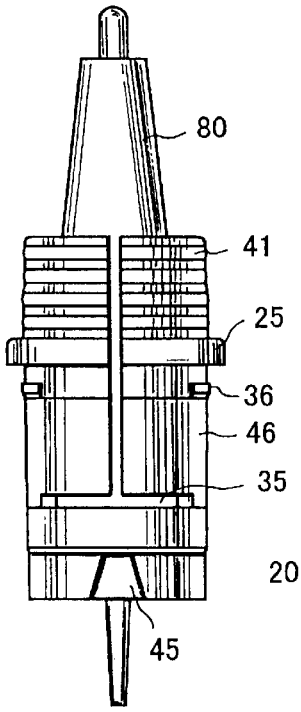
FIG. 17A is a front elevation of the distal plug employed in the sixth embodiment shown in FIG. 1.
Figure 17D:
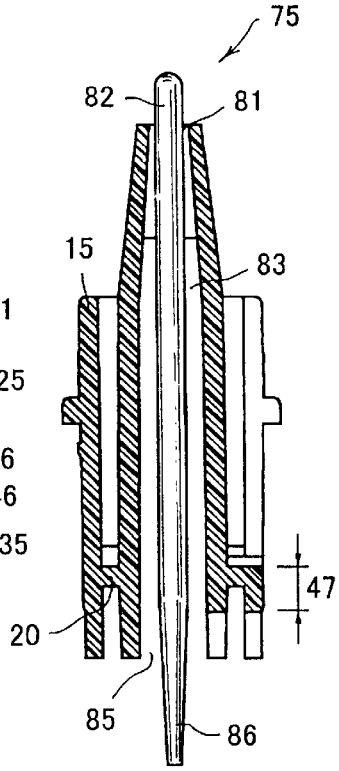
FIG. 17D is a cross section taken along the line A—A in FIG. 17C.

The distal plug 75 in the sixth embodiment, as shown in FIGS. 16 through 17D, has a penpoint tip holder 80, which is on the outer end of the plug 75 remote from the cylindrical body 2. As shown in FIG. 17D, the penpoint tip holder 80 has a cavity 83 in its inside. The holder 80 has an opening 81 on its distal end and an opening 85 on its proximal end. These openings 81 and 85 are in communication with each other through the cavity 83. In other words, the distal plug 75 is generally cylindrical and has a throughhole on its central axis.

A penpoint tip 82 is held by the penpoint tip holder 80. The penpoint tip 82 is made of the same material that is described above with the penpoint tip 5. The penpoint tip 82 is coaxial with the distal plug 75 and extends from the opening 81 through the cavity 83 to the opening 85, protruding out of the plug 75 on both of the openings 81, 85. As the distal plug 75 is attached to the cylindrical body 2, the protrusion 86 of the tip 82 on the side of the opening 85 is in contact with an ink-occlusion column 6 within the cylindrical body 2 so as to allow ink to permeate from the ink-occlusion column 6 into the tip 82.

Figure 18:
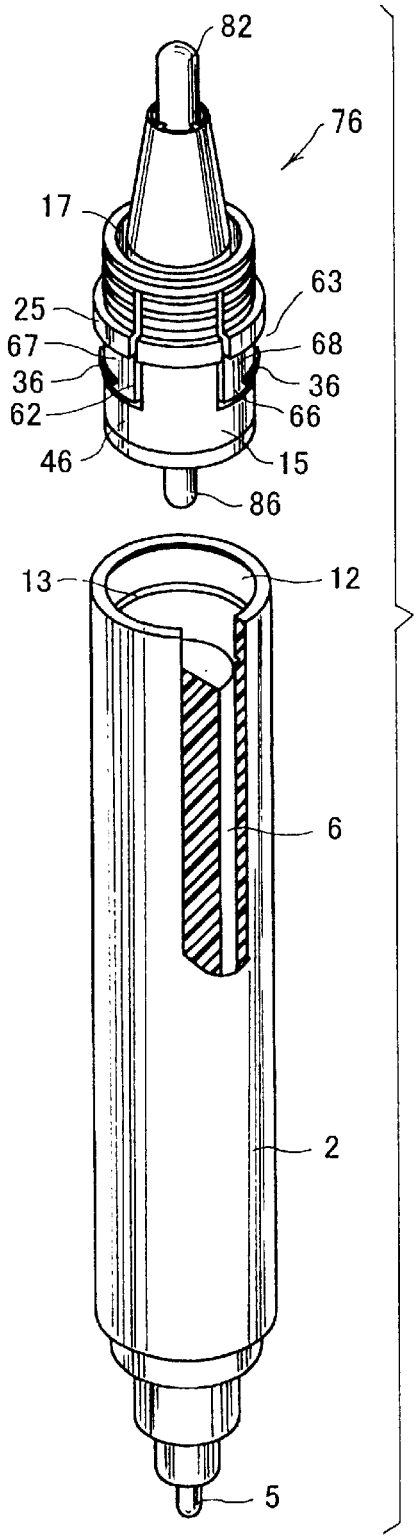
FIG. 18 is an exploded perspective view of the applicator in a seventh embodiment, with an distal plug detached from a cylindrical body of the applicator.
Figure 19:
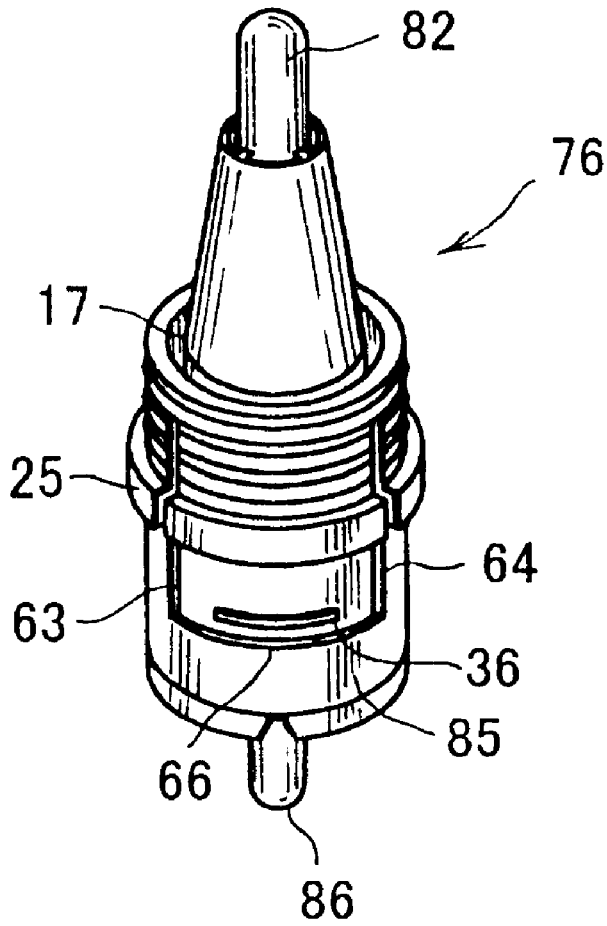
FIG. 19 is a perspective view of the distal plug shown in FIG. 18 and seen at a different angle of view.
Figure 20:
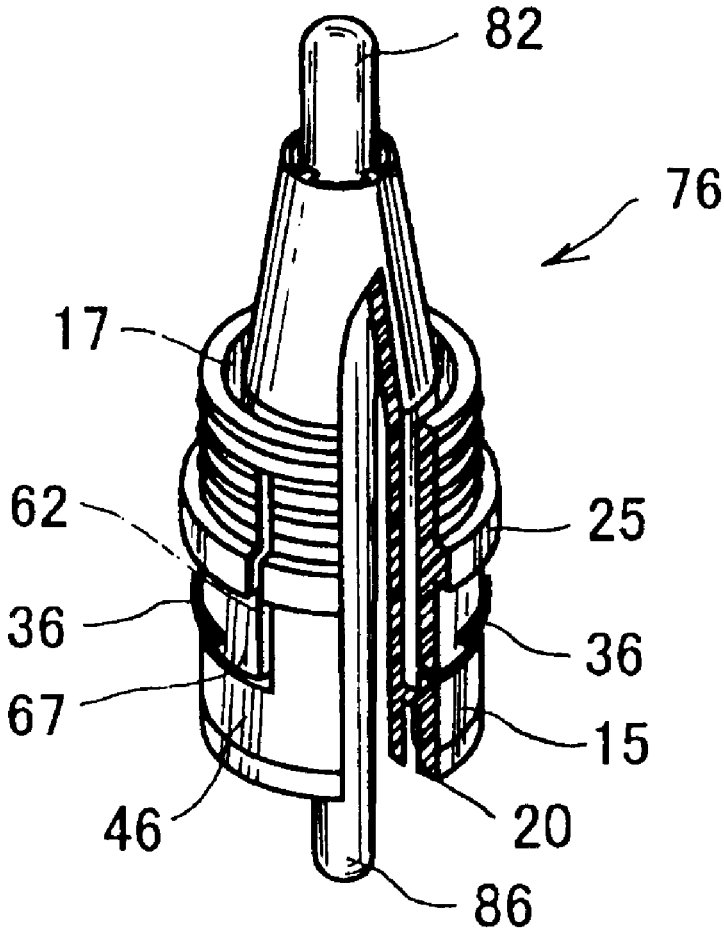
FIG. 20 is a perspective view of the distal plug shown in FIG. 18 and partly in cross section.

The distal plug 76 in the seventh embodiment, as shown in FIGS. 18 through 20, has a penpoint tip holder 80 that holds a penpoint tip 82, similar to the distal plug 75 in the sixth embodiment.

Figure 21:
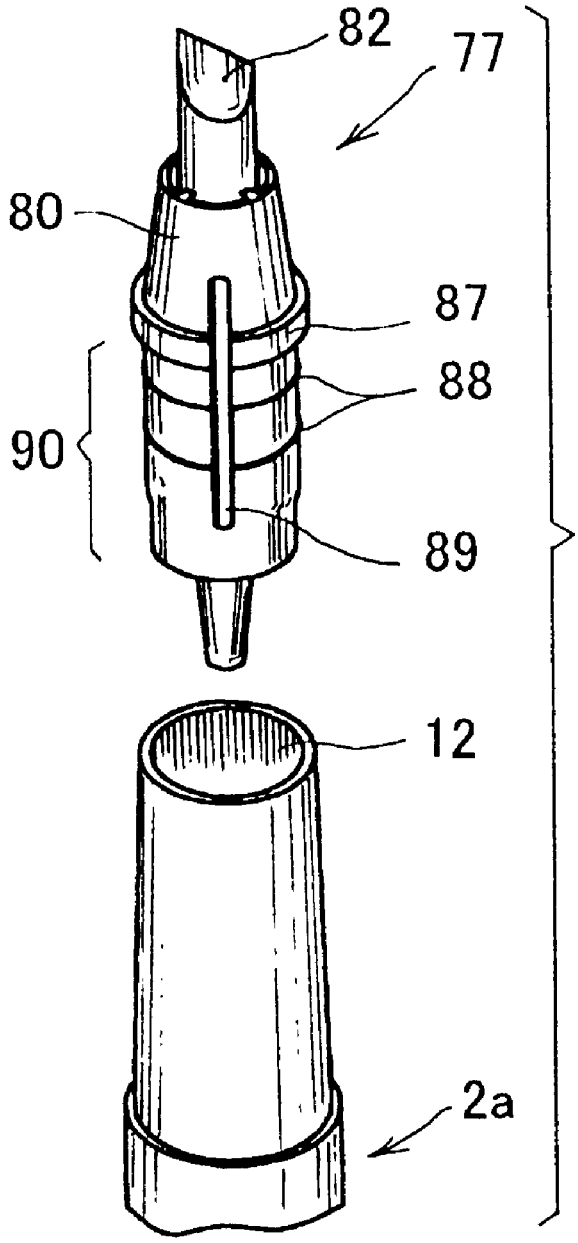
FIG. 21 is an exploded perspective fragmentary view of the applicator in a eighth embodiment, with a distal plug detached from a cylindrical body of the applicator.

The distal plug 77 in the eighth embodiment, as shown in FIG. 21, is of a hollow cylindrical shape having openings on both of its ends and having a flange 87 near the middle of its axial length. The plug 77 also has a connecting portion 90 on its body adjacent to the flange 87. The outer diameter of the connecting portion 90 is smaller than the outer diameter of the flange 87 and substantially equal to, or slightly smaller than, the inner diameter of the cylindrical body 2*a* at and in the vicinity of an opening 12 of the body 2*a*. The connecting portion 90 has two annular ribs 88 formed on its outside, which protrude radially and extend circumferentially around the portion 90.

The distal plug 77 has slots 89. The slots extend axially through the connecting portion 90 and across the flange 87. The slots 89 extend radially through the distal plug 77 so that the inner space of the hollow plug 77 is in communication with the outer space of the plug 77 through the slots 89.

If the distal plug 77 is pinched centripetally so that the width of each slot decreases, the overall diameter of curvature of the plug 77 decreases. If the flange 87 of the plug 77 is pinched centripetally so that the width of each slot decreases, the overall diameter of curvature of the flange 87 decreases, resulting in the decrease of the overall diameter of the connecting portion 90 adjacent to the flange, thus facilitating removal of the distal plug 77.

To make up an applicator, the distal plug 77 holding the penpoint tip 82 therein is fitted in the cylindrical body 2*a*. As the outer diameter of the portion 90 is substantially equal to, or slightly smaller than, the inner diameter of the cylindrical body 2*a* at and in the vicinity of an opening 12 of the body, and as the ribs 88 facilitate close contact of the plug with the inner surface of the opening 12, the plug 77 is fastened to the cylindrical body 2*a*. It is to be noted that the cylindrical body 2*a* in this embodiment has no annular groove 13, which is formed in the cylindrical body 2 employed in each of the first to seventh embodiments.

The applicator in each of the sixth to eighth embodiments also facilitates refill of ink. It is to be noted that the invention is applicable to a so-called "twin-type" applicator that has two penpoints on both end of the cylindrical body and has no proximal plug. Two detachable distal plugs may be provided on the "twin-type" applicator.

Applicators that enables refill of ink by detaching either of the distal and proximal plugs at user's discretion can also be manufactured.

It will now be apparent that the plug exemplified as the proximal or distal plug is ready to elastic distortion to reduce its temporary diameter, enabling an easy detachment thereof from the cylindrical body of applicator.

The foregoing disclosure of specific embodiments is intended to be illustrative of the broad concepts comprehended by the invention. It is to be understood that the invention is not limited to the specific embodiments except as defined in the claims.

What is claimed is:

1. An applicator comprising:

a cylindrical body to be filled with a liquid for application and having an axis, a plug selected from the group consisting of a distal plug and a proximal plug, the plug being detachably attached to an open end of the cylindrical body and having a part exposed to the outside and an axially facing outer end face on the part exposed to the outside, and at least one slot formed in the plug and extending axially of said cylindrical body, whereby the exposed part of the plug is capable of being pinched centripetally to cause elastic and temporary deformation of the plug such that an inner region thereof in a pressed contact with the cylindrical body will be forced to reduce its overall radius of curvature to thereby enable and facilitate removal of said plug from the cylindrical body, wherein each slot extends through the axially facing outer end face of the exposed part of the plug.

2. An applicator as defined in claim 1, further comprising a transverse cutout in communication with the at least one slot, wherein each slot has an inner end continuing to the transverse cutout so that the at least one slot and transverse cutout together assume a reverse T-shape.

3. An applicator comprising:

a cylindrical body to be filled with a liquid for application, the cylindrical body having a longitudinal axis, a plug selected from the group consisting of a distal plug and a proximal plug, the plug being detachably attached to an open end of the cylindrical body and having a part exposed to the outside, and at least one slot formed in the plug and extending axially of said cylindrical body, whereby the exposed part of the plug is capable of being pinched centripetally to cause elastic and temporary deformation of the plug such that an inner region thereof in a pressed contact with the cylindrical body will be forced to reduce its overall radius of curvature to thereby enable and facilitate removal of said plug from the cylindrical body, wherein each slot is formed in an intermediate region of the plug so as to have opposite axially spaced closed ends.

4. An applicator comprising:

a cylindrical body to be filled with a liquid for application, the cylindrical body having an axis, a plug selected from the group consisting of a distal plug and a proximal plug, the plug being detachably attached to an open end of the cylindrical body and having a part exposed to the outside, and at least one slot formed in the plug and extending axially of said cylindrical body, whereby the exposed part of the plug is capable of being pinched centripetally to cause elastic and temporary deformation of the plug such that an inner region thereof in a pressed contact with the cylindrical body will be forced to reduce its overall radius of curvature to thereby enable and facilitate removal of said plug from the cylindrical body, wherein the at least one slot comprises at least two longitudinal slots that are formed and connected one to another by a tying slot.

5. An applicator as defined in claim 4 wherein the at least two longitudinal slots are formed to have their ends connected by the tying slot.

6. An applicator as defined in claim 4 wherein the at least two longitudinal slots are formed in the plug and extending axially of the cylindrical body, and the at least two of the longitudinal slots have outer ends closed and also inner ends connected one to another by the tying slot.

7. An applicator as defined in claim 4 wherein the plug is composed of an outer tube and an inner tube disposed therein with the at least one slot being formed in the outer tube.

8. An applicator as defined in claim 4 wherein the plug has on its outer periphery an airtight region to be brought into a close contact with the inner periphery of the cylindrical body, when fitted therein.

9. An applicator comprising:

a cylindrical body to be filled with a liquid for application, the cylindrical body having an axis, a plug selected from the group consisting of a distal plug and a proximal plug, the plug being detachably attached to an open end of the cylindrical body and having a part exposed to the outside, and at least one flexible portion formed in the plug and extending axially of the cylindrical body, said at least one flexible portion being more subject to elastic distortion than other areas adjoining to or surrounding the at least one flexible portion by reason of at least one of a) the at least one flexible portion having a thickness, the thickness of the at least one flexible portion being decreased compared to the other areas adjoining to or surrounding the at least one flexible portion and b) the at least one flexible portion being formed of a softer material than a material defining the other areas adjoining to or surrounding the at least one flexible portion, whereby the exposed part of the plug is capable of being pinched centripetally to cause elastic and temporary deformation of the plug such that an inner region thereof in a pressed contact with the cylindrical body will be forced to reduce its overall radius of curvature to thereby enable and facilitate removal of said plug from the cylindrical body.

10. An applicator as defined in claim 9 wherein the plug is the proximal plug, and either of the plug and the cylindrical body has a protrusion formed integral therewith, and correspondingly, either of the cylindrical body and the plug has an engageable portion facing such a protrusion, and the at least one flexible portion extends inwards beyond the protrusion and engageable portion.

11. An applicator as defined in claim 10, wherein the plug is composed of an outer tube and an inner tube disposed therein, with the flexible portions being formed in the outer tube.

12. An applicator as defined in claim 10, wherein the plug has on its outer periphery an airtight region to be brought into a close contact with the inner periphery of the cylindrical body, when fitted therein.

13. An applicator comprising:

a cylindrical body to be filled with a liquid for application, the cylindrical body having an axis, a plug selected from the group consisting of a distal plug and a proximal plug, the plug being detachably attached to an open end of the cylindrical body and having a part exposed to the outside and an axially facing outer end face on the part exposed to the outside, the plug being composed of an outer tube and an inner tube disposed therein, at least one longitudinal slot formed in the outer tube and extending axially of the cylindrical body, each slot extending through the axially facing outer end face on the part of the plug exposed to the outside, either of the plug and the cylindrical body having a protrusion formed integral therewith, and correspondingly, either of the cylindrical body and the plug having an engageable portion facing such a protrusion, wherein the at least one longitudinal slot extends over and beyond the protrusion and engageable portion such that the exposed part of the plug is capable of being pinched centripetally to thereby cause elastic and temporary deformation of the plug so that an inner region of the plug in a pressed contact with the cylindrical body will be forced to reduce its overall radius of curvature to thereby enable and facilitate removal of the plug from this body, and wherein the plug has on its outer periphery an airtight region to be brought into a close contact with the inner periphery of the cylindrical body, when fitted therein.

14. An applicator as defined in claim 13, wherein at least two longitudinal slots are formed such that each of them has an inner end continuing to an extension in a circumferential direction of the outer tube.

15. An applicator as defined in claim 13, wherein more than two longitudinal slots are formed such that each of them has a fore end continuing to extensions in opposite circumferential directions of the outer tube so as to assume a T-shape as a whole.

16. An applicator as defined in claim 13, wherein annular ribs are formed on and integral with at least one portion of the outer tube, the ribs being located outside the airtight region.

17. An applicator comprising:

a cylindrical body to be filled with a liquid for application, the cylindrical body having an axis, a plug selected from the group consisting of a distal plug and a proximal plug, the plug being detachably attached to an open end of the cylindrical body and having a part exposed to the outside, the plug being composed of an outer tube and an inner tube disposed therein, at least two longitudinal slots formed in the outer tube and extending axially of the cylindrical body, at least two of the longitudinal slots having outer ends closed and also having inner ends connected one to another by a tying slot, either of the plug and the cylindrical body having a protrusion formed integral therewith, and correspondingly, either of the cylindrical body and the plug having an engageable portion facing such a protrusion, wherein each longitudinal slot extends over and beyond the protrusion and engageable portion such that the exposed part of the plug is capable of being pinched centripetally to thereby cause elastic and temporary deformation of the plug so that an inner region of the plug in a pressed contact with the cylindrical body will be forced to reduce its overall radius of curvature to thereby enable and facilitate removal of the plug from the cylindrical body, and wherein the plug has on its outer periphery an airtight region to be brought into a close contact with the inner periphery of the cylindrical body, when fitted therein.

18. An applicator as defined in claim 17, wherein an even number of the longitudinal slots are formed to provide at least one pair of them such that the two slots in each pair have inner ends connected by a tying slot so as to generally assume as a whole a U-shape defining therein a tongue-shaped region.

19. An applicator as defined in claim 17, wherein the number of the longitudinal slots is four to provide a first slot, a second slot, a third slot and a fourth slot, the first and second slots form a pair of them such that their inner ends are connected by a tying slot so as to generally assume as a whole a U-shape defining therein a tongue-shaped region, and the third and fourth slots form a further pair of them such that their inner ends are likewise connected by a further tying slot so as to generally assume as a whole a U-shape defining therein a further tongue-shaped region.

* * * * *